US012449186B2

(12) United States Patent
Dong et al.

(10) Patent No.: US 12,449,186 B2
(45) Date of Patent: Oct. 21, 2025

(54) REFRIGERATOR

(71) Applicant: LG ELECTRONICS INC., Seoul (KR)

(72) Inventors: Yongwon Dong, Seoul (KR); Younseok Lee, Seoul (KR); Sanggyun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 39 days.

(21) Appl. No.: 18/267,341

(22) PCT Filed: Dec. 9, 2021

(86) PCT No.: PCT/KR2021/018643
§ 371 (c)(1),
(2) Date: Jun. 14, 2023

(87) PCT Pub. No.: WO2022/131677
PCT Pub. Date: Jun. 23, 2022

(65) Prior Publication Data

US 2024/0044569 A1 Feb. 8, 2024

(30) Foreign Application Priority Data

Dec. 15, 2020 (KR) ..... 10-2020-0175398

(51) Int. Cl.
*F25D 23/02* (2006.01)

(52) U.S. Cl.
CPC ..... *F25D 23/028* (2013.01); *F25D 23/025* (2013.01); *F25D 2323/023* (2013.01); *F25D 2323/024* (2013.01)

(58) Field of Classification Search
CPC ..... F25D 23/025; F25D 2323/024; F25D 2400/40; F25D 23/028; F25D 2323/023;
(Continued)

(56) References Cited

U.S. PATENT DOCUMENTS 2,150,064 A * 3/1939 John ..... F25D 23/04 62/266
3,766,599 A * 10/1973 Ullman, Jr. ..... E05D 7/081 16/257

(Continued)

FOREIGN PATENT DOCUMENTS

CN 102252491 A * 11/2011
CN 110874882 3/2020

(Continued)

OTHER PUBLICATIONS

CN 102252491 translation published: 2011.*

(Continued)

*Primary Examiner* — Hiwot E Tefera
(74) *Attorney, Agent, or Firm* — KED & ASSOCIATES, LLP

(57) ABSTRACT

A refrigerator according to an embodiment comprises: a cabinet having a storage space; a main door that can rotate relative to the cabinet and opens and closes the storage space; a sub door that rotates relative to the main door; and a hinge mechanism which is connected to the main door and the sub door and provides the axis of rotation of the main door and the axis of rotation of the sub door. The axis of rotation of the main door and the axis of rotation of the sub door may be positioned on the sub door.

20 Claims, 11 Drawing Sheets

(58) Field of Classification Search
CPC ..... E05Y 2900/31; E05Y 2600/626; E05Y 2900/302; E05D 7/081; E05D 11/0054; E05D 11/0081
See application file for complete search history.

(56) References Cited

U.S. PATENT DOCUMENTS

| | | | | |
|---|---|---|---|---|
| 8,388,078 | B2 | 3/2013 | Kwon et al. | |
| 2010/0307188 | A1 | 12/2010 | Kwon | |
| 2011/0023528 | A1* | 2/2011 | Kwon | F25D 23/028 62/449 |
| 2012/0286639 | A1* | 11/2012 | Lee | F25D 23/00 312/405.1 |
| 2014/0132144 | A1 | 5/2014 | Kim et al. | |
| 2015/0059126 | A1* | 3/2015 | Dubina | E05D 11/06 16/319 |
| 2015/0233629 | A1* | 8/2015 | Choi | F25D 23/04 312/405 |
| 2016/0123654 | A1* | 5/2016 | Lee | E05D 5/02 312/405 |
| 2017/0191736 | A1* | 7/2017 | Fleig | F25D 23/028 |
| 2018/0149420 | A1 | 5/2018 | Lee | |
| 2018/0310726 | A1* | 11/2018 | Oh | F25D 23/028 |
| 2019/0257571 | A1 | 8/2019 | Park | |
| 2021/0396455 | A1* | 12/2021 | Jang | E05D 7/081 |

FOREIGN PATENT DOCUMENTS

| | | | | |
|---|---|---|---|---|
| EP | 2937651 | A1 * | 10/2015 | E05D 7/081 |
| EP | 3001125 | A1 * | 3/2016 | F25C 1/00 |
| EP | 3396282 | | 10/2018 | |
| JP | S63-142682 | | 9/1988 | |
| JP | 2004-211977 | | 7/2004 | |
| KR | 20-1999-0011033 | | 3/1999 | |
| KR | 20-2000-0007478 | | 4/2000 | |
| KR | 10-2006-0062664 | | 6/2006 | |
| KR | 10-2014-0060430 | | 5/2014 | |
| KR | 10-2016-0023741 | | 3/2016 | |
| KR | 20160035532 | A * | 3/2016 | |
| KR | 10-2018-0013178 | | 2/2018 | |
| KR | 10-2018-0024352 | | 3/2018 | |
| KR | 10-2018-0080032 | | 7/2018 | |
| KR | 10-2018-0080092 | | 7/2018 | |
| KR | 10-2018-0120005 | | 11/2018 | |
| TR | 201410337 | A2 * | 3/2016 | |
| WO | WO-0171264 | A1 * | 9/2001 | A47F 3/043 |
| WO | WO-2004029528 | A1 * | 4/2004 | F25D 23/02 |
| WO | WO 2010/010093 | | 1/2010 | |
| WO | WO 2020/043138 | | 3/2020 | |

OTHER PUBLICATIONS

International Search Report dated Mar. 17, 2022 issued in Application No. PCT/KR2021/018643.
International Search Report dated Mar. 17, 2022 issued in Application No. PCT/KR2021/018646.
International Search Report dated Mar. 23, 2022 issued in Application No. PCT/KR2021/018649.
Extended European Search Report dated Sep. 17, 2024 issued in Application No. 21906982.0.
U.S. Office Action dated Sep. 23, 2024 issued in U.S. Appl. No. 18/267,386.
Extended European Search Report dated Sep. 17, 2024 issued in Application No. 21906981.2.
Extended European Search Report dated Sep. 17, 2024 issued in Application No. 21906983.8.

* cited by examiner

REFRIGERATOR

CROSS-REFERENCE TO RELATED PATENT APPLICATIONS

This application is a U.S. National Stage Application under 35 U.S.C. § 371 of PCT Application No. PCT/KR2021/018643, filed Dec. 9, 2021, which claims priority to Korean Patent Application No. 10-2020-0175398, filed Dec. 15, 2020, whose entire disclosures are hereby incorporated by reference.

TECHNICAL FIELD

The present embodiment relates to a refrigerator.

BACKGROUND ART

In general, a refrigerator is a home appliance that stores food at a low temperature in a storage space of an interior shielded by a refrigerator door, and the refrigerator is configured to keep the stored food in an optimal condition by cooling the inside of the storage space using cold air generated through heat exchange with a refrigerant circulating in the refrigeration cycle.

The refrigerator may be independently placed in a kitchen, a living room, or the like, or may be stored in a furniture closet of a kitchen.

Refrigerators are gradually becoming larger and more multi-functional in accordance with changes in eating habits and the trend of high quality products, and refrigerators equipped with various structures and convenient devices considering user convenience are being released.

In Korean Patent Publication No. 10-2014-0060430, which is a prior document, a refrigerator is disclosed.

The refrigerator includes a main body, a storage chamber provided inside the main body so that the front surface is open and including a refrigerating chamber and a freezing chamber, an inner door provided with an opening corresponding to the size of the refrigerating chamber to open and close the refrigerating chamber, and having a plurality of door guards provided in the opening, and an outer door for opening and closing the opening.

The refrigerator includes a first coupling portion coupled to an upper portion of the main body, a first upper hinge including a first extension portion extending toward the inner door from the first coupling portion and rotatably coupled to the inner door by an upper hinge shaft, a second coupling portion coupled to an upper portion of the outer door, and a second upper hinge including a second extension portion extending toward the inner door from the second coupling portion and rotatably coupled to the upper hinge shaft coupled to the first upper hinge.

In the case of the prior document, since the upper hinge shaft and the lower hinge shaft are coupled to the inner door, when the inner door is opened while the refrigerator is located inside the furniture closet, there is a disadvantage in that In the process of opening the inner door, the outer door interferes with the furniture closet, so that the inner door cannot be opened by 90 degrees or more.

Even if the thickness of the door including the inner door and the outer door is reduced in the prior document, as long as the upper hinge shaft and the lower hinge shaft are configured to be coupled to the inner door, there is a limit to increasing the door opening angle of the inner door.

In addition, in the case of the prior document, since the upper hinge shaft is configured to pass through the second extension portion of the second upper hinge connected to the outer door and the insertion tube located inside the inner door at the same time, there is a disadvantage in that the length of the upper hinge shaft becomes longer, and thus the space for assembling the doors must be large. In addition, since the upper hinge shaft must pass through the insertion tube and the second extension portion at the same time, there is a disadvantage in that operator's work convenience is reduced.

DISCLOSURE

Technical Problem

The present embodiment provides a refrigerator in which the opening angle of a door can be increased even when the refrigerator is located in a furniture closet.

Optionally or additionally, the present embodiment provides a refrigerator capable of securing a door opening angle while reducing the thickness of the door.

Optionally or additionally, the present embodiment provides a refrigerator in which a hinge mechanism for rotating a door and a door are easily assembled.

Technical Solution

A refrigerator according to an aspect may include a cabinet having a storage space; a main door rotatable with respect to the cabinet and opening and closing the storage space; a sub door rotatable with respect to the main door; and a hinge mechanism connected to the main door and the sub door and providing a rotation center of the main door and a rotation center of the sub door.

The rotation center of the main door and the rotation center of the sub door may be located on the sub door.

The rotation center of the main door and the rotation center of the sub door may extend from the sub door in a vertical direction.

The rotation center of the main door may coincide with the rotation center of the sub door.

The hinge mechanism may include a hinge bracket fixed to the cabinet; and a first hinge pin coupled to the hinge bracket and providing a rotation center of the main door.

The hinge mechanism may further include a fixing bracket coupled to the main door; and a second hinge pin coupled to the fixing bracket and providing a rotation center of the sub door.

The first hinge pin and the second hinge pin may be aligned in the vertical direction in a state in which the first hinge pin is located above the second hinge pin.

A portion of the first hinge pin may be located inside the second hinge pin.

The hinge bracket may include a first opening to which the first hinge pin is coupled, and the fixing bracket may include a second opening to which the second hinge pin is coupled.

The first opening and the second opening may be aligned in a vertical direction.

The first opening of the hinge bracket may be spaced apart from the second opening of the fixing bracket in an upward direction.

The hinge mechanism may further include a first bushing rotatable with respect to the first hinge pin; and a second bushing rotatable with respect to the second hinge pin.

The first hinge pin may include a first shaft accommodated in the first bushing. The first hinge pin may further include a coupling body coupled to the first opening.

The second hinge pin may include a second shaft and a pin body extending from the second shaft. The first bushing may be accommodated and fixed in the pin body. At least a portion of the first shaft may be located in the pin body in a state of being accommodated in the first bushing.

The second bushing may include a lower body accommodating the second shaft and an upper body accommodating the pin body.

An outer diameter of the upper body may be greater than an outer diameter of the lower body. An inner diameter of the upper body may be greater than an outer diameter of the lower body.

The sub door may include a hinge coupling portion for accommodating the second bushing.

The second bushing may be accommodated in the hinge coupling portion, at least a portion of the second hinge pin may be located in the hinge coupling portion in a state in which the second hinge pin is accommodated in the second bushing.

At least a portion of the first hinge pin may be located inside the second hinge pin and inside the hinge coupling portion.

The first bushing may be located between the first hinge pin and the second hinge pin. At least a portion of the first bushing may be located within the hinge coupling portion.

The second bushing may be fixed to the sub door, the first bushing is fixed to the second hinge pin.

When the main door may rotate, the fixing bracket, the second bushing, the second hinge pin, and the first bushing rotate together, and the first bushing may relatively rotate with respect to the first hinge pin.

When the sub door rotates, the second bushing may rotate together, and the second bushing may relatively rotate with respect to the second hinge pin.

A refrigerator according to another aspect may include a cabinet having a storage space; a hinge bracket fixed to the cabinet and having a first hinge pin; a main door opening and closing the storage space and rotatable with respect to the first hinge pin; a fixing bracket provided on the main door and having a second hinge pin; and a sub door rotatable with respect to the second hinge pin.

The first hinge pin and the second hinge pin may be located in the sub door.

The first hinge pin and the second hinge pin may be aligned on the sub door in a vertical direction. A portion of the first hinge pin may be accommodated in the second hinge pin.

A first bushing may be provided between the first hinge pin and the second hinge pin. The first bushing may be fixed to the second hinge pin. The first bushing may accommodate a portion of the first hinge pin.

The second bushing may be provided in the sub door. The second bushing may rotate relative to the second hinge pin. The second bushing may accommodate a portion of the second hinge pin.

Advantageous Effect

According to the present embodiment, even if the refrigerator is located inside the furniture closet, the opening angle of the door can be increased.

According to the present embodiment, the door opening angle can be secured while reducing the thickness of the door.

The present embodiment has the advantage of easy assembly of the hinge mechanism for rotating the door and the door.

BEST MODE

Figure 1:
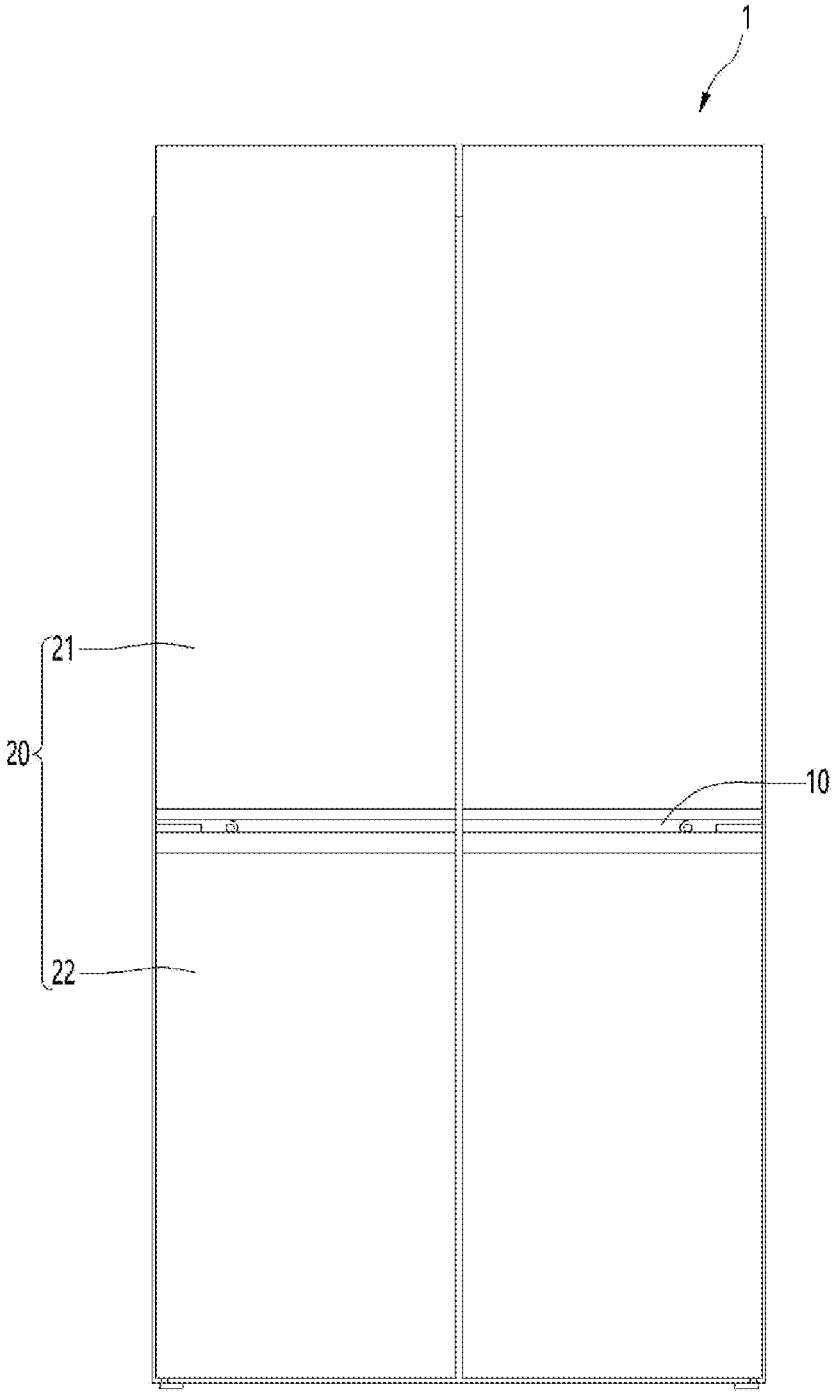
FIG. 1 is a front view illustrating a refrigerator according to the present embodiment.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
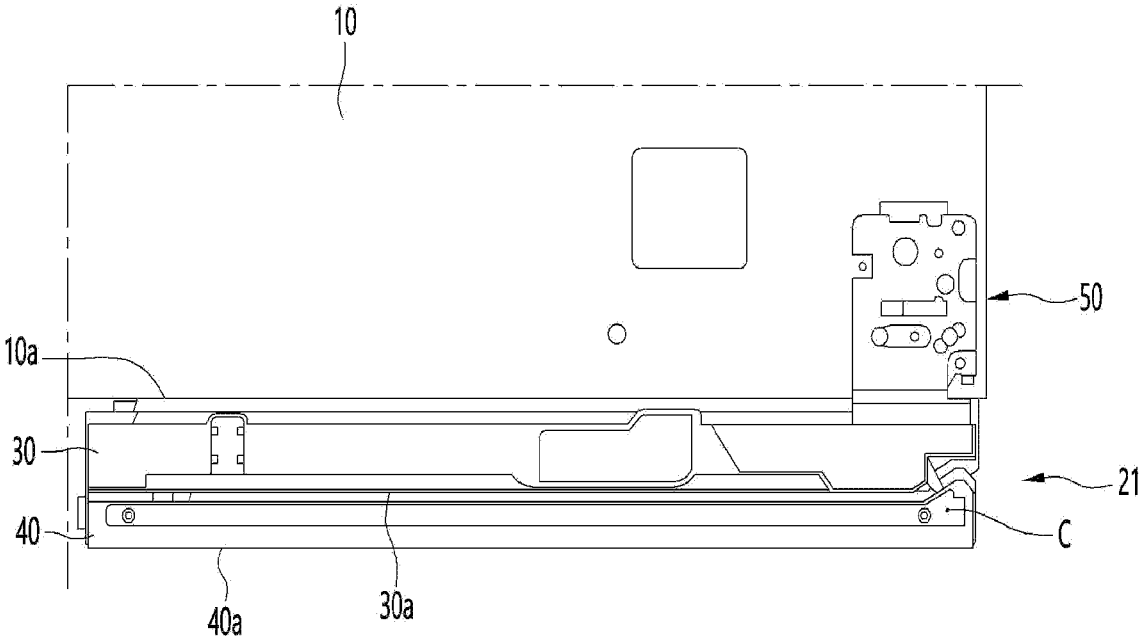
FIG. 2 is a view illustrating a portion of a plan view of the refrigerator according to the present embodiment.
Figure 3:
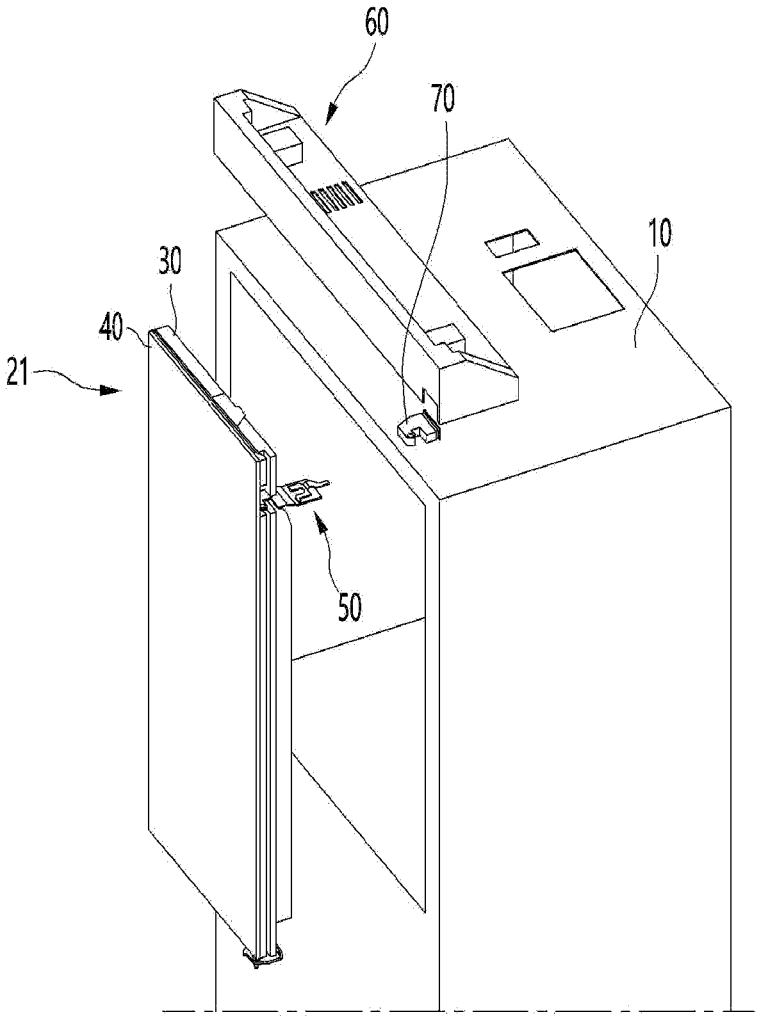
FIG. 3 is a view illustrating a state where one door of the present embodiment is separated.
Figure 4:
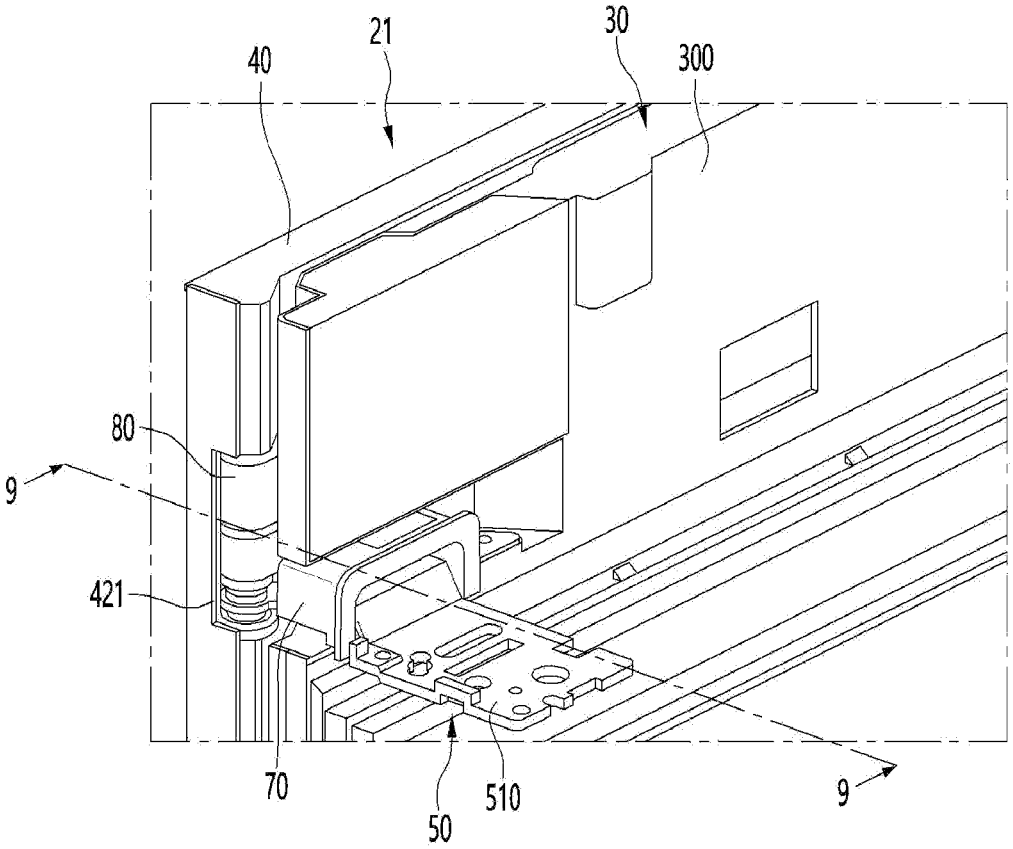
FIG. 4 is a view illustrating a state where a hinge mechanism is coupled to a door of the present embodiment.

FIG. 1 is a front view illustrating a refrigerator according to the present embodiment, FIG. 2 is a view illustrating a portion of a plan view of the refrigerator according to the present embodiment, FIG. 3 is a view illustrating a state where one door of the present embodiment is separated, and FIG. 4 is a view illustrating a state where a hinge mechanism is coupled to a door of the present embodiment.

Referring to FIGS. 1 to 4, the refrigerator 1 according to the present embodiment may be installed independently in a kitchen or installed in a state of being accommodated in an indoor furniture closet. When the refrigerator 1 is installed in the indoor furniture closet, the refrigerator 1 may be installed alone or arranged side by side with other refrigerators.

The refrigerator 1 may include a cabinet 10 having a storage space and a refrigerator door 20 opening and closing the storage space.

The storage space is not limited, but may be divided into an upper first space and a lower second space, and the refrigerator door 20 also may include a first door 21 opening and closing the first space and the second door 22 opening and closing the second space.

The first space may be a refrigerating chamber, and the second space may be a freezing chamber or vice versa. Alternatively, it is also possible that the storage space includes a first space and a second space divided into left and right sides. Alternatively, the storage space may be a single space, and a single refrigerator door may open and close the storage space.

At least one of the first door 21 and the second door 22 may be a rotation type door. Alternatively, the single refrigerator door 20 may be a rotation type door.

In the present embodiment, a state where the two first doors 21 are disposed in the left and right direction will be described as an example. In addition, in the present embodiment, a state where the first door on the right side including the main door 30 and the sub door 40 will be described as an example. Of course, it is also possible that the first door 21 on the left side includes the main door 30 and the sub door 40.

Hereinafter, the first door including the main door 30 and the sub door 40 will be referred to as "door 21" for convenience of description.

The main door 30 is rotatably connected to the cabinet 10 by a hinge mechanism 50 and can open and close the storage space.

The main door 30 may include a door frame 300 having an opening. The door frame 300 may form an outer appearance of the main door 30. The opening of the door frame 300 may communicate with the storage space. A door storage portion such as a basket may be additionally provided at the opening of the door frame or at the rear side of the door frame 300.

The sub door 40 may open and close the opening of the main door 30. For example, the sub door 40 may open the opening while the main door 30 is closed. Alternatively, the main door 30 may be opened together with the sub door 40 in a state in which the opening of the main door 30 is closed by the sub door 40.

The sub door 40 may open and close the opening in front of the main door 30. In other words, as illustrated in FIG. 2, the front surface 40*a* of the sub door 40 may be located in front of the front surface 30*a* of the main door 30. The distance between the front surface 40*a* of the sub door 40 and the front surface 10*a* of the cabinet 10 may be longer than the distance between the front surface 30*a* of the main door 30 and the front surface 10*a* of the cabinet 10.

The sub door 40 may be connected to the hinge mechanism 50. The sub door 40 can rotate with respect to the cabinet 10 and the main door 30 by the hinge mechanism 50.

The hinge mechanism 50 may include a hinge bracket 510. A portion of the hinge bracket 510 may be fixed to the upper surface of the cabinet 10. In a state in which the hinge bracket 510 is fixed to the cabinet 10, another portion of the hinge bracket 510 may protrude forward from the front surface 10*a* of the cabinet 10.

Another portion of the hinge bracket 510 may cross the main door 30 and extend toward the sub door 40.

For example, the upper surface of the main door 30 may be located higher than the hinge bracket 510. In this case, the hinge bracket 510 may pass through the main door 30.

The sub door 40 may include a hinge accommodation portion 421 for accommodating the hinge bracket 510 passing through the main door 30. For example, the hinge accommodation portion 421 may be formed as the rear surface of the sub door 40 is recessed forward.

The refrigerator 1 may further include a wire guide 80 for guiding a wire (not illustrated) electrically connected to components inside the main door 30. Of course, the wire guide 80 may be omitted.

The refrigerator 1 may further include a bracket cover 70 covering at least a portion of the hinge bracket 510.

The bracket cover 70 may cover a portion extending forward of the cabinet 10 from the hinge bracket 510. When the bracket cover 70 covers the hinge bracket 510, exposure of the hinge mechanism 50 to the outside can be minimized. The bracket cover 70 may be disposed to align with the wire guide 80 in a vertical direction. Of course, the bracket cover 70 may be omitted.

The refrigerator 1 may further include an upper cover 60 fixed to an upper surface of the cabinet 10. The upper cover 60 may be combined with the bracket cover 70. The upper cover 60 may cover the hinge bracket 510. Exposure of the hinge mechanism 50 to the outside can be minimized by the upper cover 60. Of course, the upper cover 60 may be omitted.

Figure 5:
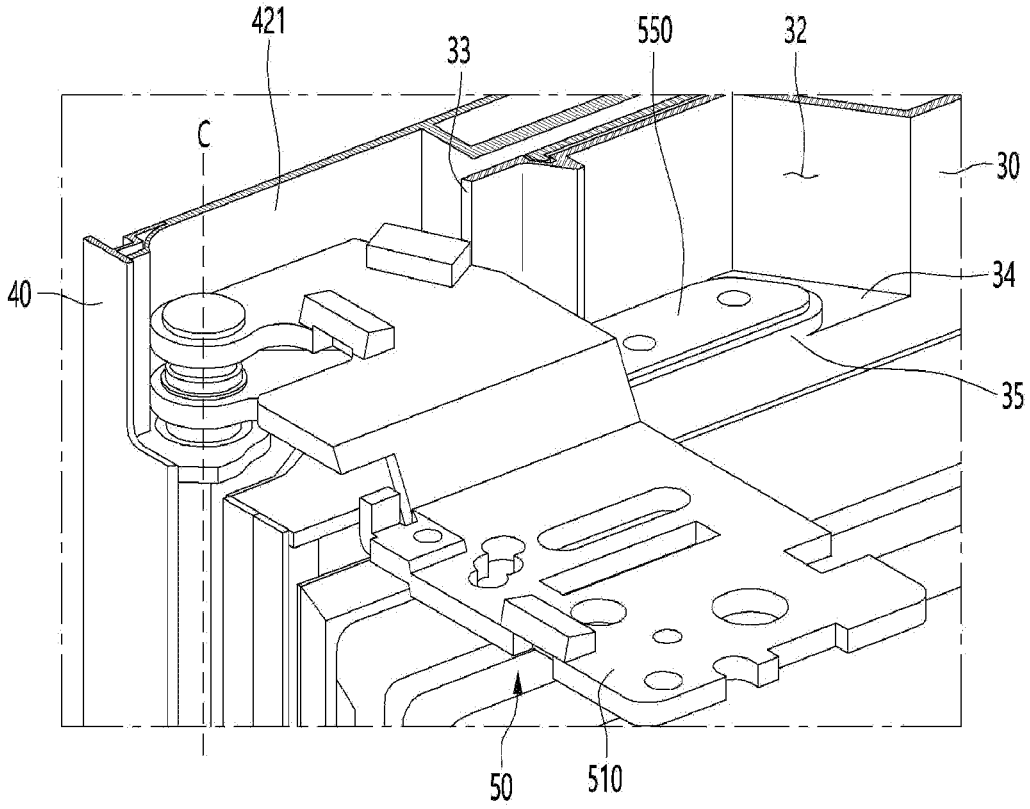
FIG. 5 is a view illustrating a state where upper portions of the main door and the sub door are partially cut off.
Figure 6:
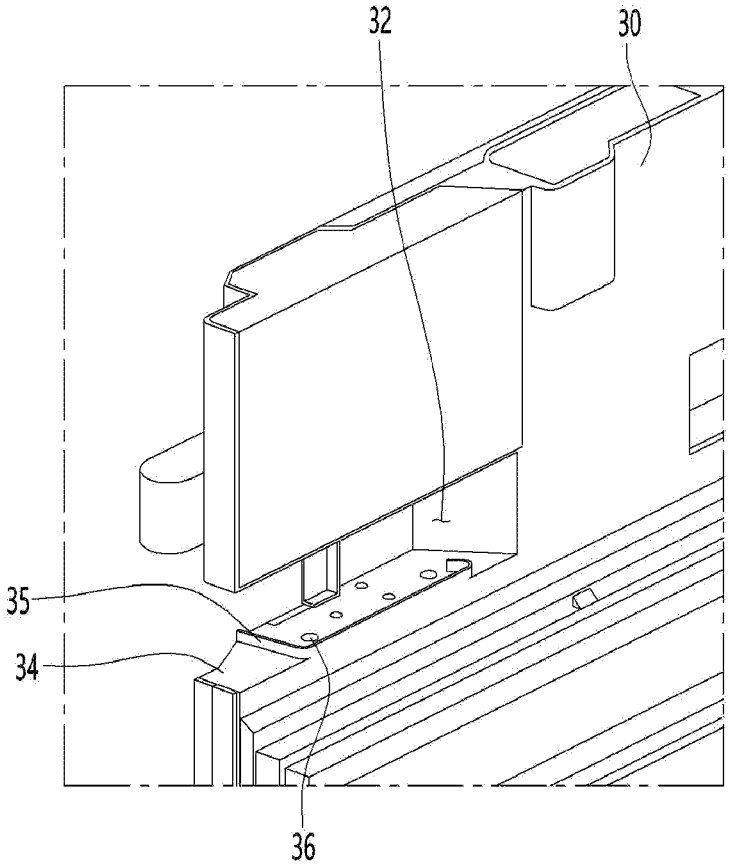
FIG. 6 is a view illustrating a hinge accommodation portion of the main door.

FIG. 5 is a view illustrating a state where upper portions of the main door and the sub door are partially cut off, and FIG. 6 is a view illustrating a hinge accommodation portion of the main door.

Referring to FIGS. 2, 5, and 6, the main door 30 may include a hinge accommodation portion 32 for accommodating a portion of the hinge bracket 510. The hinge accommodation portion 32 may be formed as the rear surface of the main door 30 is recessed toward the front surface.

The main door 30 may include a slot 33 through which the hinge bracket 510 passes. In a state in which the hinge bracket 510 passes through the slot 33, the hinge bracket 510 may be located in the hinge accommodation portion 32. A portion of the hinge bracket 510 passing through the slot 33 may be located in the hinge accommodation portion 421 of the sub door 40.

The hinge mechanism 50 may provide a rotation center C (or a rotation center shaft) of the main door 30 and a rotation center C of the sub door 30.

The rotation center C may be located in the sub door 40. For example, the rotation center C may extend from the sub door 30 in the vertical direction.

A portion of the hinge mechanism 50 located in the hinge accommodation portion 421 of the sub door 40 may provide the rotation center C. In other words, the rotation center C may be located in front of the front surface 30*a* of the main door 30.

The rotation center C of the main door 30 may coincide with the rotation center C of the sub door 30. In other words, the main door 30 and the sub door 30 may have the same rotation center C.

The hinge mechanism 50 may further include a fixing bracket 550 to be fixed to the main door 30. For example, a coupling guide 35 for guiding coupling of the fixing bracket 550 may be provided at the bottom 34 of the hinge accommodation portion 32 of the main door 30.

The coupling guide 35 may protrude upward from the bottom 34 of the hinge accommodation portion 32. The coupling guide 35 is formed in a shape corresponding to a portion of the fixing bracket 550 and may cover a portion of the circumference of the fixing bracket 550 placed on the bottom 34 of the hinge accommodation portion 32. A plurality of fastening holes 36 may be formed in the bottom 34 of the hinge accommodation portion 32. The fastening member may be fastened to the fixing bracket 550 and the fastening hole 36.

The fixing bracket 550 may be formed of a metal material to prevent deformation when the main door 30 or the sub door 40 rotates. On the other hand, the bottom 34 of the hinge accommodation portion 32 may be formed of a non-metallic material.

To increase the fastening force between the fixing bracket 550 and the bottom 34 of the hinge accommodation portion 32, which are made of different materials, a separate fastening plate (not illustrated) for fastening to the fixing bracket 550 may be provided below the bottom 34 of the hinge accommodation portion 32. For example, the fastening plate may be formed of a metal material. In this case, in a state in which the bottom 34 of the hinge accommodation portion 32 is located between the fastening plate and the fixing bracket 550, the fixing bracket 550, the bottom 34 of the hinge accommodation portion 32, and the fastening plate may be fastened by a fastening member. Of course, the fastening plate may be omitted.

A portion of the fixing bracket 550 is located in the hinge accommodation portion 32 of the main door 30, and the other portion thereof passes through the slot 33 of the main door 30 to be located in the hinge accommodation portion 421 of the sub door 40. The rotation center C may pass through the fixing bracket 550 located in the hinge accommodation portion 421.

Hereinafter, the hinge mechanism 50 will be described in detail.

Figure 7:
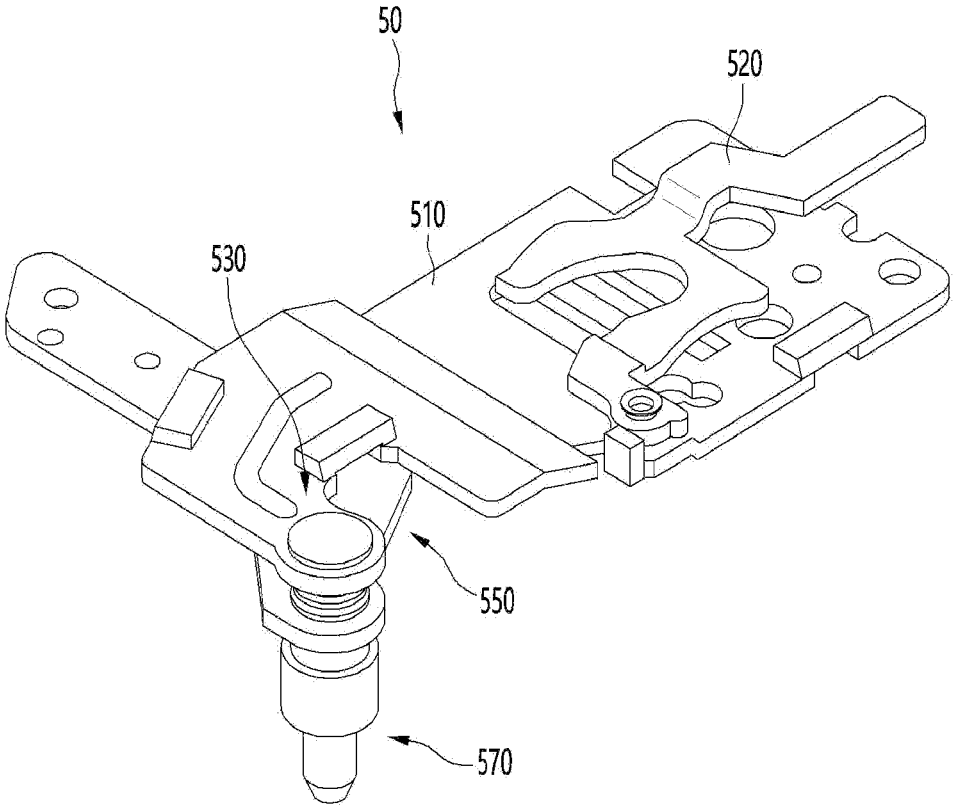
FIG. 7 is a perspective view illustrating the hinge mechanism according to the present embodiment.
Figure 8:
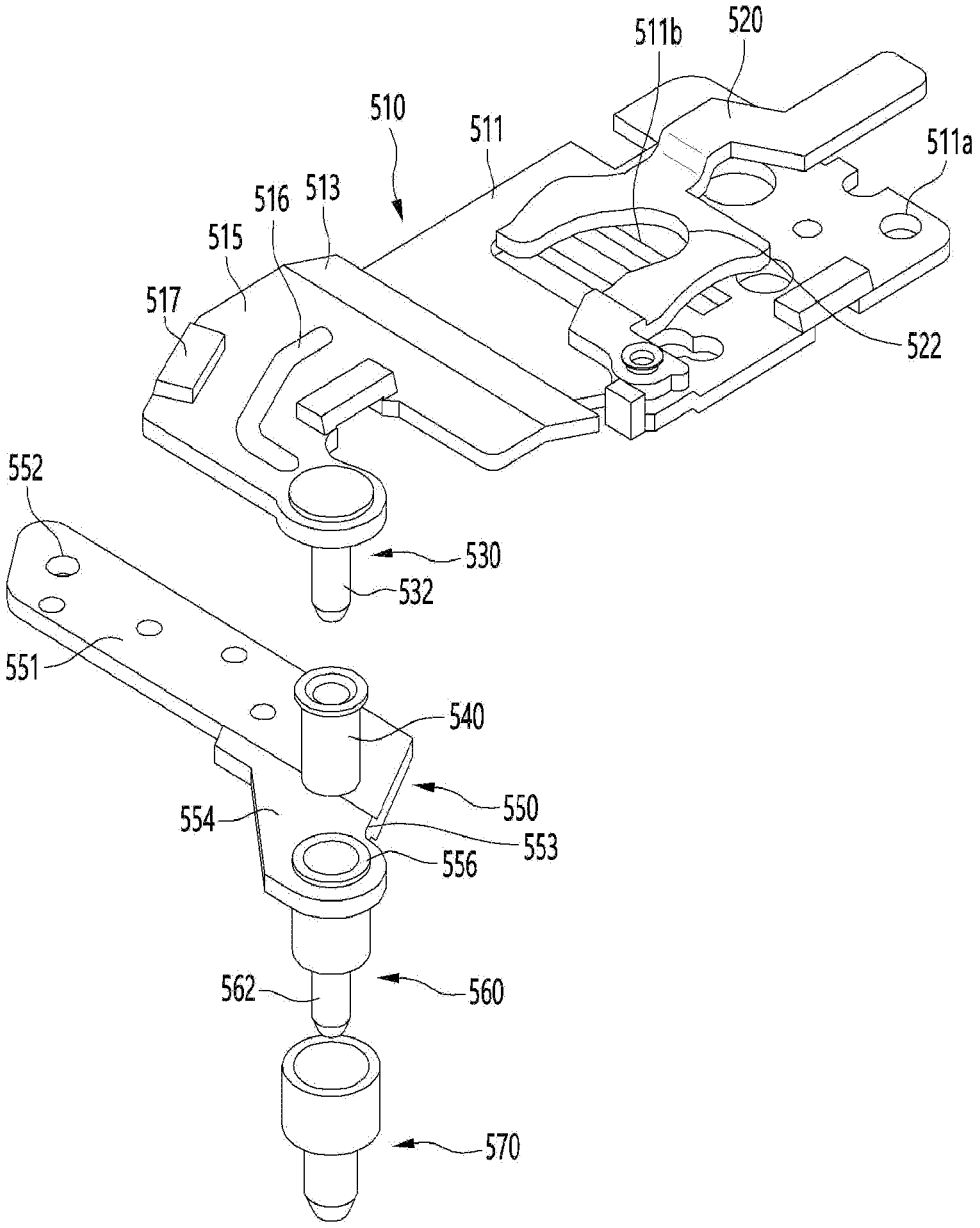
FIG. 8 is an exploded perspective view illustrating the hinge mechanism according to the present embodiment.
Figure 9:
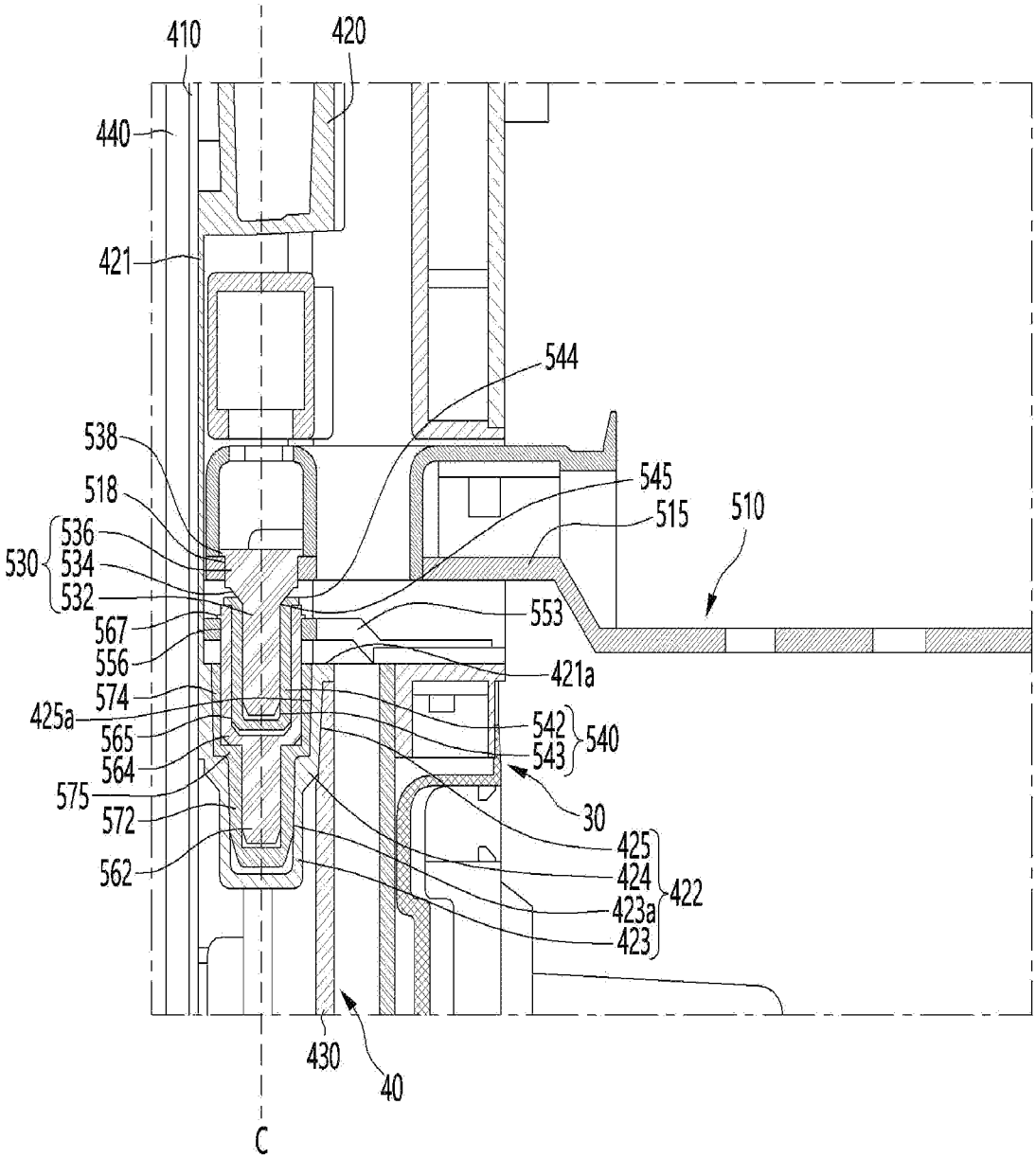
FIG. 9 is a cross-sectional view taken along line 9-9 in FIG. 4.

FIG. 7 is a perspective view illustrating the hinge mechanism according to the present embodiment, FIG. 8 is an exploded perspective view illustrating the hinge mechanism according to the present embodiment, and FIG. 9 is a cross-sectional view taken along line 9-9 in FIG. 4.

Referring to FIGS. 5 to 9, the hinge mechanism 50 may include a hinge bracket 510 as described above.

The hinge bracket 510 may include a first bracket 511 seated and fixed to the cabinet 10.

The first bracket 511 may include a plurality of fastening holes 511*a* through which fastening members to be fastened to the cabinet 10 pass.

The first bracket 511 may further include a rib through-hole 511*b* through which a fixing rib (not illustrated) provided in the cabinet 10 passes. Of course, the rib through-hole 511*b* may be omitted.

The hinge bracket 510 may further include a second bracket 513 extending to be inclined from the first bracket 511. The second bracket 513 may extend from an end portion of the first bracket 511 to be inclined upward toward the front. Of course, it is also possible that the second bracket 513 extends vertically upward from the end portion of the first bracket 511.

The hinge bracket 510 may further include a third bracket 515 extending horizontally forward from the second bracket 513.

For example, the first bracket 511 and the third bracket 515 may be parallel to each other, and may have different heights due to the second bracket 513. The third bracket 515 may be located higher than the first bracket 511.

The third bracket 515 may pass through the slot 33 of the main door 30. The third bracket 515 passing through the slot 33 of the main door 30 may be located in the hinge accommodation portion 421 of the sub door 40.

The rotation center C may pass through the third bracket 515 in a vertical direction.

A strength reinforcement portion 516 may be provided in the third bracket 515. A cover coupling portion 517 for coupling the bracket cover 70 may be provided on the third bracket 515. Although not limited, at least two cover coupling portions 517 may be provided in the third bracket 515. In this case, although not limited, the strength reinforcement portion 516 may be located between the two cover coupling portions 517. One or more cover coupling portions may also be formed in the first bracket 511. Of course, when the bracket cover 70 is omitted, the cover coupling portion 517 may also be omitted.

The hinge bracket 510 may include a first opening 518. The first opening 518 may be formed to pass through the hinge bracket 510 in a vertical direction. The rotation center C may pass through the first opening 518.

For example, the first opening 518 may be formed in the third bracket 515. The first opening 518 may be located at an end portion of the third bracket 515.

The hinge mechanism 50 may further include a lever 520 rotatably connected to the hinge bracket 510. For example, the lever 520 may be rotatably connected to the first bracket 511.

The lever 520 may be provided with a recessed portion 522 forming a space in which the fixing rib passing through the rib through-hole 511*b* is located. During rotation of the lever 520, the fixing rib may be located in the recessed portion 522 without interfering with the lever 520. Of course, in the present embodiment, the lever 520 may be omitted.

The hinge mechanism 50 may further include a first hinge pin 530. The first hinge pin 530 may enable rotation of the main door 30. For example, the first hinge pin 530 may provide a center of rotation of the main door 30.

The first hinge pin 530 may include a first shaft 532. The first shaft 532 may be formed in a cylindrical shape, for example.

The first hinge pin 530 may further include an extension portion 534 extending upward from the first shaft 532. The diameter of the extension portion 534 may increase from the upper end portion of the first shaft 532 to the upper side.

The first hinge pin 530 may further include a coupling body 536 extending upward from the extension portion 534. The coupling body 536 may have a larger diameter than the diameter of the first shaft 532. The coupling body 536 may be equal to or larger than the diameter of the upper end portion of the extension portion 534.

The coupling body 536 may be coupled to the first opening 518. The coupling body 536 may have a diameter equal to or greater than that of the first opening 518, so that the coupling body 536 may be fitted into the first opening 518.

The length of the coupling body 536 in the vertical direction may be greater than the thickness of the third bracket 515.

The length of the coupling body 536 in the vertical direction may be longer than the length of the extension portion 534 in the vertical direction. The length of the first shaft 532 in the vertical direction may be longer than the length of the coupling body 536 in the vertical direction.

The outer diameter of the first shaft 532 may be equal to or greater than 5 mm and equal to or less than 10 mm to prevent an increase in the thickness of the door while securing strength.

The first hinge pin 530 may further include a first flange 538 extending in a horizontal direction around the coupling body 536. For example, the first flange 538 may be continuously formed along the circumference of the upper end of the coupling body 536.

The first flange 538 may be seated on the upper surface of the third bracket 515 in a state in which the coupling body 536 is fitted into the first opening 518. Accordingly, the first flange 538 may limit the downward movement of the first hinge pin 530.

When the first hinge pin 530 is coupled to the hinge bracket 510 as a separate component, assembly by an operator can be improved and the length of the first hinge pin 530 itself can be reduced, and thus there is an advantage that the restrictions of the working space can be reduced.

Since the first hinge pin 530 is fixed to the hinge bracket 510, the main door 30 can rotate around the fixed first hinge pin 530.

The hinge mechanism 50 may further include a first bushing 540 coupled to the first shaft 532. The first bushing 540 may be rotatably coupled to the first shaft 532. The first shaft 532 may be formed of a metallic material, and the first bushing 540 may be formed of a non-metallic material. Therefore, the first bushing 540 can smoothly rotate with respect to the first shaft 532 by the first bushing 540.

The first bushing 540 may include a first body 542 including a space 543 for accommodating the first shaft 532. The first body 542 may be formed in a cylindrical shape, for example.

The length of the first body 542 in the vertical direction may be equal to or greater than the length of the first shaft 532 in the vertical direction.

The first bushing 540 may further include a flange 544 extending in a horizontal direction from an upper end portion of the first body 542. For example, the flange 544 may be continuously formed along the upper circumference of the first body 542.

An inclined surface 545 corresponding to the inclination of the extension portion 534 may be included on the inner circumferential surface of the upper end of the first body 542 to prevent interference with the extension portion 534. In other words, the upper end portion of the first body 542 may surround the extension portion 534.

The hinge mechanism 50 may further include the fixing bracket 550 described above. The fixing bracket 550 may include a door coupling bracket 551 fixed to the main door 30. The door coupling bracket 551 may include a plurality of fastening holes 552 corresponding to the plurality of fastening holes 36 of the main door 30.

The third bracket 515 may be disposed to overlap the door coupling bracket 551 in the vertical direction within the hinge accommodation portion 32 of the main door 30.

At this time, the third bracket 515 of the hinge bracket 510 may be located higher than the first bracket 511. The third bracket 515 located in the hinge accommodation portion 32 of the main door 30 may be spaced apart from the bottom 34 of the hinge accommodation portion 32.

Since the third bracket 515 is spaced upward from the bottom 34 of the hinge accommodation portion 32, a space in which the door coupling bracket 551 can be located may be formed between the third bracket 515 and the bottom 34 of the hinge accommodation portion 32.

In a state in which the door coupling bracket 551 is fixed to the bottom 34 of the hinge accommodation portion 32, the third bracket 515 may be spaced apart from the door coupling bracket 551.

The fixing bracket 550 may further include an extension bracket 553 extending to be inclined from the door coupling portion 552. The extension bracket 553 may be inclined upward toward the front from the door coupling bracket 551. Of course, it is also possible for the extension bracket 553 to extend vertically upward from the door coupling bracket 551.

The fixing bracket 550 may further include a support bracket 554 extending in a horizontal direction from the extension bracket 553. The support bracket 554 may be located higher than the door coupling bracket 551 by the extension bracket 553.

To prevent the support bracket 554 from interfering with the third bracket 515, the length of the extension bracket 553 in the vertical direction may be shorter than the length of the second bracket 513 in the vertical direction. Accordingly, the support bracket 554 may be spaced apart from the third bracket 515 at a lower side of the third bracket 515.

In the present embodiment, as long as the support bracket 554 and the third bracket 515 are spaced apart, the shapes of the hinge bracket 510 and the fixing bracket 550 are not limited to those described above and may be modified into various shapes.

The fixing bracket 550 may include a second opening 556. The second opening 556 may be formed to pass through the fixing bracket 550 in a vertical direction. The second opening 556 may be aligned with the first opening 518 of the hinge bracket 510 in a vertical direction. Accordingly, the rotation center C may pass through the first opening 518 and the second opening 556. For example, the second opening 556 may be formed in the support bracket 554.

The hinge mechanism 50 may further include a second hinge pin 560. The second hinge pin 560 may enable rotation of the sub door 40 with respect to the main door 30. For example, the second hinge pin 560 may provide a rotation center C of the sub door 40. At this time, the rotation center C of the main door 30 provided by the first hinge pin 530 and the rotation center C of the sub door 40 provided by the second hinge pin 560 coincide with each other.

The second hinge pin 560 may include a second shaft 562. The second shaft 562 may be formed in a cylindrical shape, for example.

The second hinge pin 560 may further include a pin body 564 extending upward from the second shaft 562.

The pin body 564 may include an accommodation space 565 for accommodating the first body 542 of the first bushing 540. An inner circumferential surface of the pin body 564 forming the accommodation space 565 may be in contact with an outer circumferential surface of the first bushing 540.

A length of the pin body 564 in the vertical direction may be longer than a length of the second shaft 562 in the vertical direction. Accordingly, the first bushing 540 may be accommodated in the pin body 564, and the first shaft 532 may be accommodated in the first bushing 540 within the pin body 564.

The outer diameter of the second shaft 562 may be equal to or greater than 5 mm and equal to or less than 10 mm to prevent an increase in the thickness of the door while securing strength.

The first body 542 of the first bushing 540 may be fitted and coupled to the pin body 564. Therefore, the first bushing 540 can rotate with respect to the first shaft 532 in a state of being fixed to the pin body 564 during the rotation of the main door 30.

The pin body 564 may be coupled to the second opening 556. The diameter of the pin body 564 is equal to or larger than the diameter of the second opening 556, so that the pin body 564 can be fitted into the second opening 556.

The pin body 564 may further include a second flange 567 extending in a horizontal direction around the pin body 564. For example, the second flange 567 may be continuously formed along the circumference of the pin body 564 at a position spaced downward from an upper end of the pin body 564. In a state in which the pin body 564 is coupled to the second opening 556, the second flange 567 may be seated on an upper surface of the support bracket 554.

When the second hinge pin 560 is coupled to the support bracket 554 as a separate component, the operator's assembling ability can be improved and the length of the second hinge pin 560 itself can be reduced and thus there is an advantage that the restrictions of the working space can be reduced.

In addition, since the second hinge pin 560 exists as a separate component from the first hinge pin 530, the operator's assembling ability can be improved during the door assembly process, and the restrictions of the working space can be reduced.

In a state in which the first body 542 of the first bushing 540 is accommodated in the pin body 564, the flange 544 of the first bushing 540 may be seated on the upper end of the pin body 564. The flange 544 of the first bushing 540 may be spaced apart from the third bracket 515.

In the present embodiment, since the first bushing 540 is disposed between the first hinge pin 530 and the second hinge pin 560, even when the first shaft 532 is located inside the second hinge pin 560, direct friction between the first shaft 532 and the second hinge pin 560 can be prevented.

In the present embodiment, since the first shaft 532 is accommodated in the second hinge pin 560, even if the rotation centers C of the main door 30 and the sub door 40 coincide with each other, an increase in the height of the hinge mechanism 50 can be minimized.

The hinge mechanism 50 may further include a second bushing 570 coupled to the second shaft 562. The second bushing 570 may be coupled to the second shaft 562 to be relatively rotatable. The second shaft 562 may be formed of a metallic material, and the second bushing 570 may be formed of a non-metallic material. The second bushing 570 can smoothly rotate with respect to the second shaft 562 during the rotation process of the sub door 40 by the second bushing 570.

The second bushing 570 may include a lower body 572 accommodating the second shaft 562 and an upper body 574 accommodating the pin body 564.

The inner diameter of the upper body 574 may be larger than that of the lower body 572. An outer diameter of the upper body 574 may be larger than that of the lower body 572.

Due to the difference in diameter between the lower body 572 and the upper body 574, the second bushing 570 may include a stepped surface 575. The pin body 564 may be seated on the stepped surface 575. In a state in which the pin body 564 is seated on the stepped surface 575, an end portion of the upper body 574 may be spaced apart from a lower surface of the support bracket 554.

Meanwhile, the sub door 40 may include a portion or all of a front frame 421, a door frame 420 coupled to the front frame 421, and a door liner 410 coupled to the door frame.

A front panel 440 may be detachably coupled to the front surface of the front frame 421. The front panel 440 may be formed of, for example, a glass material. In this case, the front panel 440 may form the outer appearance of the front surface of the sub door 40.

As another example, the front panel 440 may be omitted. In this case, the front frame 421 may form the outer appearance of the front surface of the sub door 40.

The door frame 420 may include the hinge accommodation portion 421. For example, the hinge accommodation portion 421 may be formed as the rear surface of the door frame 420 is recessed toward the front surface.

In the door frame 420, the bottom surface 421*a* of the hinge accommodation portion 421 may be provided with a recessed hinge coupling portion 422. The rotation center C may pass through the hinge coupling portion 422 in a vertical direction.

For example, the second bushing 570 may be coupled to the hinge coupling portion 422.

The hinge coupling portion 422 may include a first accommodation portion 423 having a first space 423*a*, and a second accommodation portion 425 extending upward from the first accommodation portion 423 and having a second space 425*a*.

An inner diameter of the second accommodation portion 425 may be larger than an inner diameter of the first accommodation portion 423.

The lower body 572 of the second bushing 570 may be accommodated in the first accommodation portion 423. The upper body 574 of the second bushing 570 may be accommodated in the second accommodation portion 425.

Due to the difference in diameter between the first accommodation portion 423 and the second accommodation portion 425, the hinge coupling portion 422 may further include a support portion 424 which supports the stepped surface 575 of a second bushing 570.

In a state in which the second bushing 570 is coupled to the hinge coupling portion 422, when the sub door 40 rotates, the hinge coupling portion 422 and the second bushing 570 together may rotate about the hinge pin 560.

A lower surface of the support bracket 554 may be spaced apart from a bottom surface 421*a* of the hinge accommodation portion 421. An upper end of the second bushing 570 may be spaced apart from a lower surface of the support bracket 554 in a state of being coupled to the hinge coupling portion 422.

The assembly process of the hinge mechanism 50 will be briefly described.

A second bushing 570 may be coupled to the hinge coupling portion 422 of the sub door 40.

The second hinge pin 560 may be coupled to the fixing bracket 550. In this state, when the fixing bracket 550 is fixed to the main door 30 and the second hinge pin 560 is inserted into the second bushing 570, the main door 30 and the sub door 40 may be connected.

The first bushing 540 may be coupled to the second hinge pin 560. The first hinge pin 530 may be coupled to the hinge bracket 510.

When the hinge bracket 510 is fixed to the cabinet 10 and the first hinge pin 530 is inserted into the first bushing 540, assembly of the hinge mechanism 50 may be completed.

Figure 10:
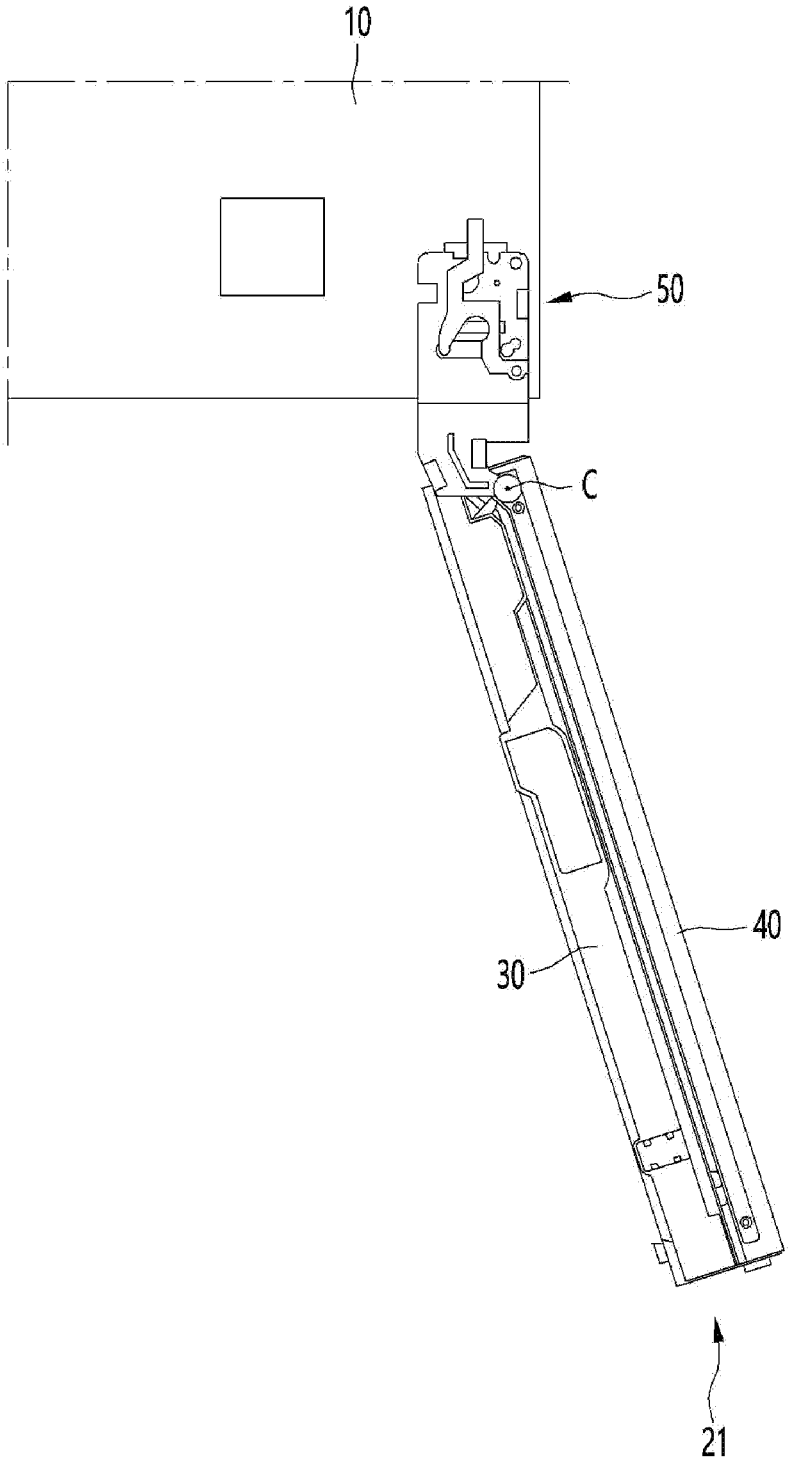
FIG. 10 is a view illustrating a state where the main door and the sub door rotate together.
Figure 11:
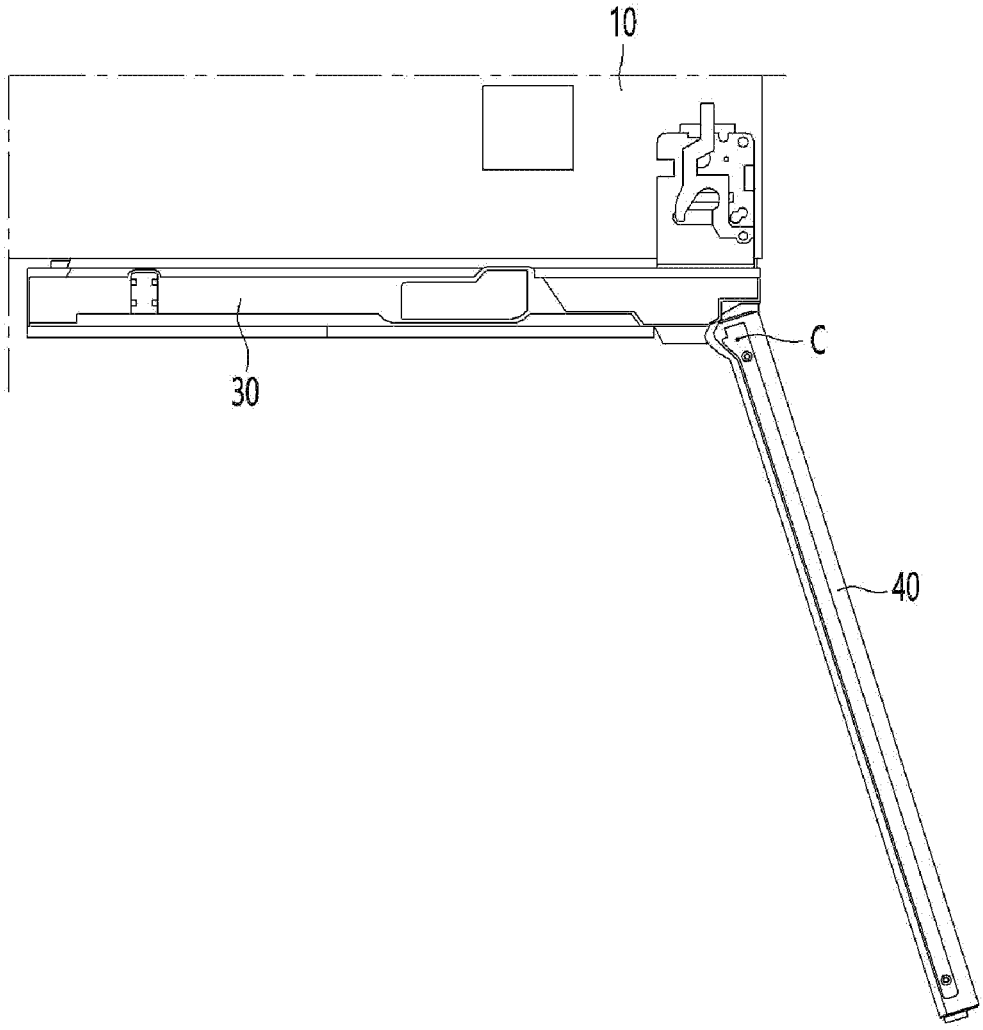
FIG. 11 is a view illustrating a state where the sub door rotates in a state where the main door is closed.

FIG. 10 is a view illustrating a state where the main door and the sub door rotate together, and FIG. 11 is a view illustrating a state where the sub door rotates in a state in which the main door is closed.

Referring to FIG. 10, when the main door 30 is opened, the sub door 40 may rotate together with the main door 30. The main door 30 may rotate based on the rotation center C. Since the rotation center C is located at the sub door 40 as described above, the distance between the front surface of the sub door 40 and the rotation center C is reduced, thereby, during the rotation of the main door 30, the possibility of the sub door 40 colliding with surrounding structures may be reduced.

In addition, even if the thickness of the main door 30 is reduced, when the rotation centers C of the main door 30 and the sub door 40 are located on the sub door 40, while rotation of the main door 30 is possible, during the rotation process of the main door 30, the possibility that the sub door 40 collides with surrounding structures may be reduced.

Referring to FIG. 11, in a state in which the main door 30 is closed, the sub door 40 may rotate about the rotation center C. Since the rotation center C of the sub door 40 is located on the sub door 40, the possibility of the sub door 40 colliding with surrounding structures during the rotation of the sub door 40 can be reduced.

When the refrigerator is accommodated in a furniture closet, if the overall thickness of the door 21 is reduced, the length of the door 21 protruding from the front surface of the furniture closet may be reduced.

Although not limited, when the total thickness of the door 21 is 55 mm or less, the front surface of the door 21 may be prevented from protruding from the front surface of the furniture closet. While the door 21 having this thickness includes the main door 30 and the sub door 40, the rotation center C may be located in the sub door 40.

When the rotation center C is located in the sub door 40, the distance from the rotation center C to the front surface of the sub door 40 may be within a range of 13 mm to 15 mm. In this case, an adiabatic space may be formed between the front surface of the sub door 40 and the rotation center C.

The invention claimed is:

1. A refrigerator comprising:

a cabinet having a storage space;

a hinge mechanism coupled to the cabinet;

a main door coupled by the hinge mechanism to be rotatable with respect to the cabinet to open and close the storage space; and a sub door coupled to the hinge mechanism to be rotatable with respect to the main door, wherein the hinge mechanism comprises a first hinge pin, a second hinge pin, and a first bushing rotatable with respect to the first hinge pin, wherein the main door together with the sub door is rotatable with respect to the first hinge pin, and the sub door is rotatable with respect to the second hinge pin, wherein a rotation axis of the main door and a rotation axis of the sub door extend into the sub door, and wherein a portion of the first bushing is received inside the second hinge pin.

2. The refrigerator of claim 1, wherein the hinge mechanism includes:

a hinge bracket fixed to the cabinet; and a fixing bracket coupled to the main door;

wherein the first hinge pin is coupled to the hinge bracket and providing the rotation axis of the main door, and the second hinge pin is coupled to the fixing bracket and providing the rotation axis of the sub door.

3. The refrigerator of claim 2, wherein the first hinge pin and the second hinge pin are vertically aligned and the first hinge pin is located above the second hinge pin, and/or wherein the rotation axis of the main door coincides with the rotation axis of the sub door.

4. The refrigerator of claim 3, wherein at least a portion of the first hinge pin is received inside the second hinge pin.

5. The refrigerator of claim 2, wherein the hinge bracket includes a first opening to which the first hinge pin is coupled, wherein the fixing bracket includes a second opening to which the second hinge pin is coupled, and wherein the first opening and the second opening are aligned in a vertical direction.

6. The refrigerator of claim 5, wherein the first opening of the hinge bracket is spaced apart from the second opening of the fixing bracket in the vertical direction.

7. The refrigerator of claim 2, wherein the hinge mechanism further includes:

a second bushing rotatable with respect to the second hinge pin.

8. The refrigerator of claim 7, wherein the first hinge pin includes a first shaft a least partially accommodated in the first bushing.

9. The refrigerator of claim 8, wherein the second hinge pin includes a second shaft and a pin body tube extending from the second shaft, wherein the first bushing is fixedly accommodated in the pin body tube, and wherein at least a portion of the first shaft is located in the pin body tube and accommodated in the first bushing.

10. The refrigerator of claim 9, wherein the second bushing includes a lower body section accommodating at least a portion of the second shaft and an upper body section accommodating at least a portion of the pin body.

11. The refrigerator of claim 7, wherein the sub door includes a hinge coupling recess accommodating at least a portion of the second bushing.

12. The refrigerator of claim 11, wherein at least a portion of the second hinge pin is received in the hinge coupling recess and in the second bushing, and wherein at least a portion of the first hinge pin is located inside the second hinge pin and inside the hinge coupling recess.

13. The refrigerator of claim 12, wherein the first bushing is located between the first hinge pin and the second hinge pin, and wherein at least a portion of the first bushing is located within the hinge coupling recess.

14. The refrigerator of claim 7, wherein the second bushing is fixed to the sub door, the first bushing is fixed to the second hinge pin and, wherein, when the main door rotates, the fixing bracket, the second bushing, the second hinge pin, and the first bushing rotate together.

15. The refrigerator of claim 14, wherein the second bushing rotates together with the sub door, and wherein the second bushing rotates relative to the second hinge pin.

16. A refrigerator comprising:

a cabinet having a storage space;

a hinge bracket coupled to the cabinet and having a first hinge pin;

a main door configured to open and close the storage space and rotatable with respect to the first hinge pin;

a fixing bracket coupled to the main door and having a second hinge pin;

a first bushing rotatable with respect to the first hinge pin; and a sub door rotatable with respect to the second hinge pin;

wherein a front surface of the sub door is located in front of a front surface of the main door, wherein the sub door includes an opening to receive at least a portion of the first hinge pin, at least a portion of the second hinge pin, and at least a portion of the first bushing, and wherein a portion of the first bushing is received inside the second hinge pin.

17. The refrigerator of claim 16, wherein the first hinge pin and the second hinge pin are aligned in the opening of the sub door in a vertical direction.

18. The refrigerator of claim 17, wherein at least a portion of the first hinge pin is located inside an opening in the second hinge pin.

19. The refrigerator of claim 18, further comprising:

a second bushing at least partially accommodated in the opening of the sub door and configured to accommodate at least a portion of the second hinge pin, wherein the first bushing is configured to accommodate at least a portion the first hinge pin.

20. A refrigerator comprising:

a cabinet having a storage space;

a hinge bracket coupled to the cabinet and having a first hinge pin;

a main door configured to open and close the storage space and rotatable with respect to the first hinge pin;

a fixing bracket coupled to the main door and having a second hinge pin;

a bushing rotatable with respect to the first hinge pin; and a sub door rotatable with respect to the second hinge pin, wherein the sub door includes an opening to receive at least a portion of the first hinge pin, at least a portion of the second hinge pin, and a least a portion of the bushing and a portion of the second hinge pin is positioned lower than a lower end of the first hinge pin, and wherein a portion of the bushing is received inside the second hinge pin.

* * * * *